United States Patent [19]

Gjerde

[11] 4,193,714

[45] Mar. 18, 1980

[54] METHOD FOR ERECTING A DECK ON A MARINE STRUCTURE

[75] Inventor: Trygve Gjerde, Jar, Norway

[73] Assignees: A/S Hoyer-Ellefsen; Ing. T. Furuholmen; Ing. F. Selmer A/S, all of Oslo, Norway

[21] Appl. No.: 927,001

[22] Filed: Jul. 24, 1978

[51] Int. Cl.[2] ..... E02B 17/00

[52] U.S. Cl. ..... 405/204; 405/195

[58] Field of Search ..... 405/196, 197, 204, 221, 405/227, 203, 205, 195, 198, 199, 200

[56] References Cited

U.S. PATENT DOCUMENTS

| | | | |
|---|---|---|---|
| 3,456,447 | 7/1969 | MacKintosh | 405/203 |
| 4,041,711 | 8/1977 | Lucas | 405/197 |

*Primary Examiner*—Dennis L. Taylor

*Attorney, Agent, or Firm*—Larson, Taylor and Hinds

[57] ABSTRACT

A method is provided for mounting a deck superstructure, comprising at least one concrete girder and/or beam, on a supporting structure intended to operate in marine surroundings. The supporting structure comprises at least one column which extends above sea level and the method comprises the steps of bringing the deck superstructure, either as a unit or in sections, in position relative to the column, hoisting the deck superstructure up to the final position thereof using cables and a jacking system, and tensioning the cables upon the arrival of the deck superstructure in its final position. The lower ends of the cables are permanently anchored to the deck superstructure while the upper ends of the cables are connected to hoisting and tensioning devices arranged on top of the column. The lower ends of the cables are arranged within the concrete girder and/or beam in such a way that the cables, upon tensioning, form an integral part of the static system of the deck superstructure, therby providing both vertical and shear reinforcement.

4 Claims, 9 Drawing Figures

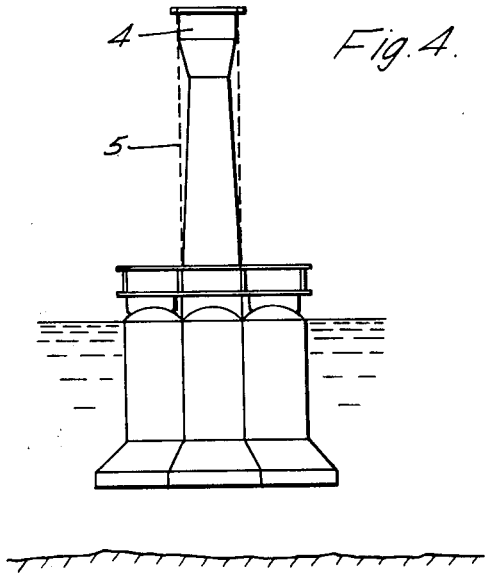
Fig. 4.
Fig. 5.
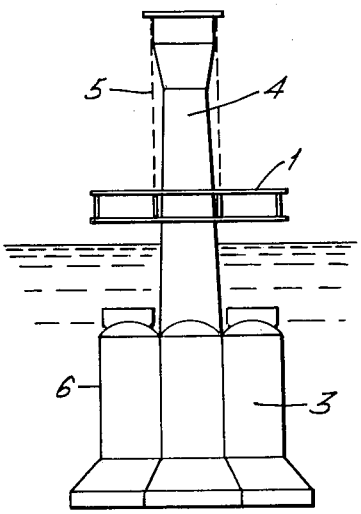
Fig. 6.
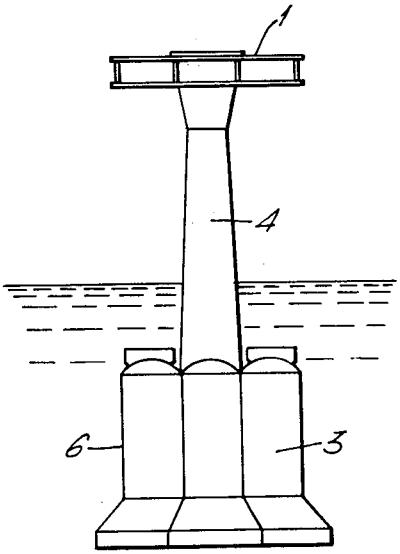

METHOD FOR ERECTING A DECK ON A MARINE STRUCTURE

The present invention relates to a method for mounting a deck structure on a supporting structure designed to operate in marine surroundings. The supporting structure comprises a bouyant body, submerged while in operating position, and one or more towers, columns or legs, extended above sea level, designed to support the deck structure. The supporting structure may either be of a type resting on the sea bed or of a semisubmersible type. According to the present invention, the deck is brought, wholly or in sections, into position at the lower end of the tower(s). The deck/deck sections are then lifted into place using a system of cables or rods, anchored to the deck/deck sections, and lifting/clamping devices mounted on the supporting structure. When the deck/deck section are in place, it/they are then preferably permanently secured to the tower(s).

When mounting deck structures on marine oil-drilling and production platforms, it is essential provide a solution that is safe, economical and expedient, yet makes possible exceptionally heavy lifting of 2,000 tons or more. A simple method for mounting is also needed.

In U.S. Pat. Nos. 3,876,181 and 3,857,247, it has been proposed to build the deck and the supporting structure separately, floating these out to a suitable site for the mating operation. The deck is maneuvered in between the legs of the supporting structure and jacked up from the water along the legs of the structure so that the deck clears the water surface without being affected by waves. The deck is lifted by using removable jacking legs, mounted to the upper end of the towers of the supporting structure. The jacking legs extend down to the underside of the deck. The jacking mechanism is mounted on deck and surrounding the jacking legs. The deck may thus be pulled to the top of the supporting structure. After the deck is fastened to the supporting structure, the jacks and jacking legs are removed. According to a previously proposed method, the jacks are arranged on top of the supporting structures tower(s), with the jacking legs detachably fastened to the deck.

The object of the present application is to improve the techniques that were previously used when mounting a deck on a marine supporting structure. A further object is to provide a solutuion where unwanted relative movement, and especially jerky movement of the deck in relation to the towers during lifting, is reduced to a minimum. Such movements could be caused by wind and waves. Still another object is to provide a solution where parts of the cables/rods used for jacking up the deck, form an integrated and statically contributing part of the static system of the completed platform. The ultimate object is to provide a less complicated and more economical platform structure. It should be noted that it is important that the deck structure is not exposed to movements caused by waves when lying close to the waterline.

According to the present invention, the method provides: that the deck/sections are secured against relative movement caused by waves during lifting-operations; that the lower end of the cables/rods are permanently fastened to the deck/sections; that at least parts of the cables or rods, after final placement and adjustment of the deck/sections, are prestressed vertically between the deck/sections and the tower(s), whereby said cables/rods act as prestressing cables, fastening the deck/sections to the tower(s), thereby forming an integrated and statically contributing part of the final constructions static system.

According to the present invention, the lower end of the cables or rods are permanently anchored so far down in the deck girders that the cables, after the final prestressing, will form part of the shear reinforcement. Further, the lower part of the cables have sufficient free length before the final prestressing and eventual injection (grouting) to produce amply controlled extension upon application of the prestressing force.

The lower end of the cables are anchored in the lower half of the deck girders, while the rest of the cables are, at least prior to the prestressing, positioned detached in vertical slots, holes, recesses or pipes within the girders.

A preferred method of constructing a marine platform structure is described in more detail, with reference to the drawings, where:

FIGS. 1–6 show different stages of the building and mounting of the deck onto the supporting structure;

Figure 1:
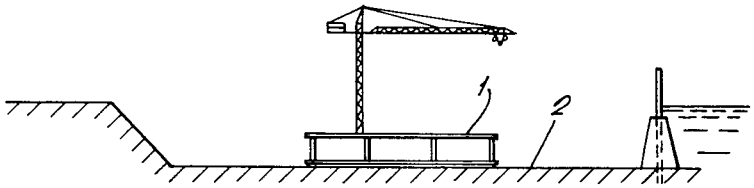
Figure 2:
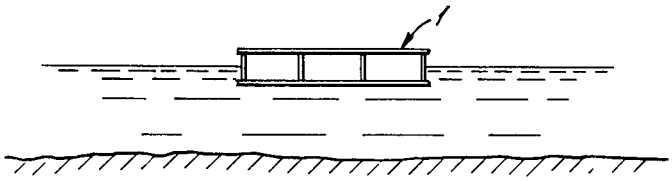
Figure 3:
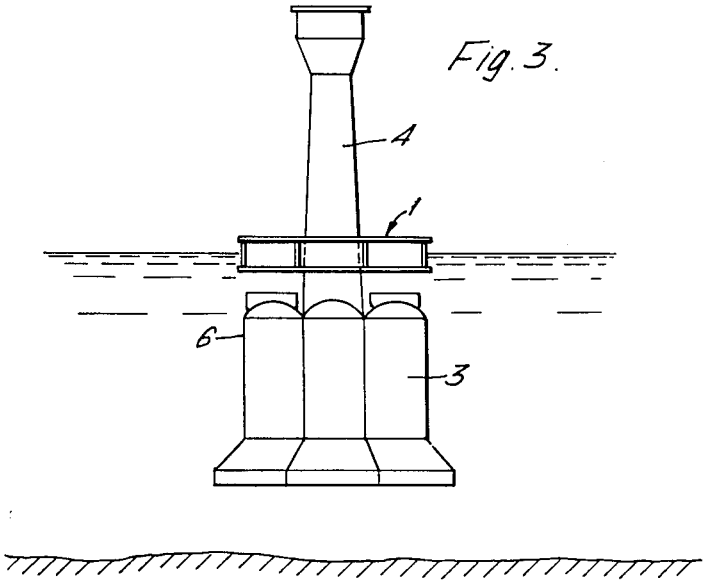

FIGS. 1–6 show different stages of building and mounting a deck onto a supporting structure. The deck 1 is preferably built as a floating unit in a dock 2 (FIG. 2). The dock may be formed by for instance damming up an inlet or cove with sheet piping, with subsequent draining of the area behind the piling. When floating the deck, water is pumped into the dock and the sheet piling wall is removed. The deck is then floated out (FIG. 2). Alternatively, the deck may be built on a slanting berth, either as a floating unit or on pontoons. It should be noted that the deck also may be built on a peninsula, quay, or the like, for later towage to site on pontoons or barges. Yet another alternative is building the deck on top af the caisson 3. FIG. 3 shows the deck ready for mounting by the supporting structure 6. The supporting structure may consist of a caisson 3 and a tower 4, extending from the caisson up beyong the water surface. The caisson consists of several cells, forming a floating unit. When bringing the deck 1 into position for mounting on the supporting structure 6, the supporting structure is ballasted to the point where the caisson is submerged sufficiently to allow positioning of the deck over the structure. The deck is then floated over the caisson 3. After the deck is in position relative to the tower 4, the caisson 3 is deballasted enough to allow the deck 1 to be lifted above the water surface by the caisson 3. The jacking rods/cables 5 are then mounted between the deck 1 and jacks (not shown in FIG. 4) situated on top of the tower 4. The lower end of the jacking rods/cables 5 are permanently anchored to the deck 1, while their upper end is connected to the jacks. The deck may now be lifted into place. The jacking/lifting operation may either be performed offshore or inshore in calmer waters. If the deck is mated inshore, it is, from a stability point of view, advantageous to let the deck hang an ample height above the water surface during tow to the field. (See FIG. 5). The deck is thereby sufficiently above the sea level not to be affected by waves. According to the above described solution, the deck may either be elevated prior to positioning on the offshore site or the remaining jacking- /lifting may be performed simultaneously to emplacing the supporting structure 6 in its final position.

FIG. 6 schematically shows the supporting structure 6 with the deck 1 placed in its final position on top of the tower 4.

Figure 7:
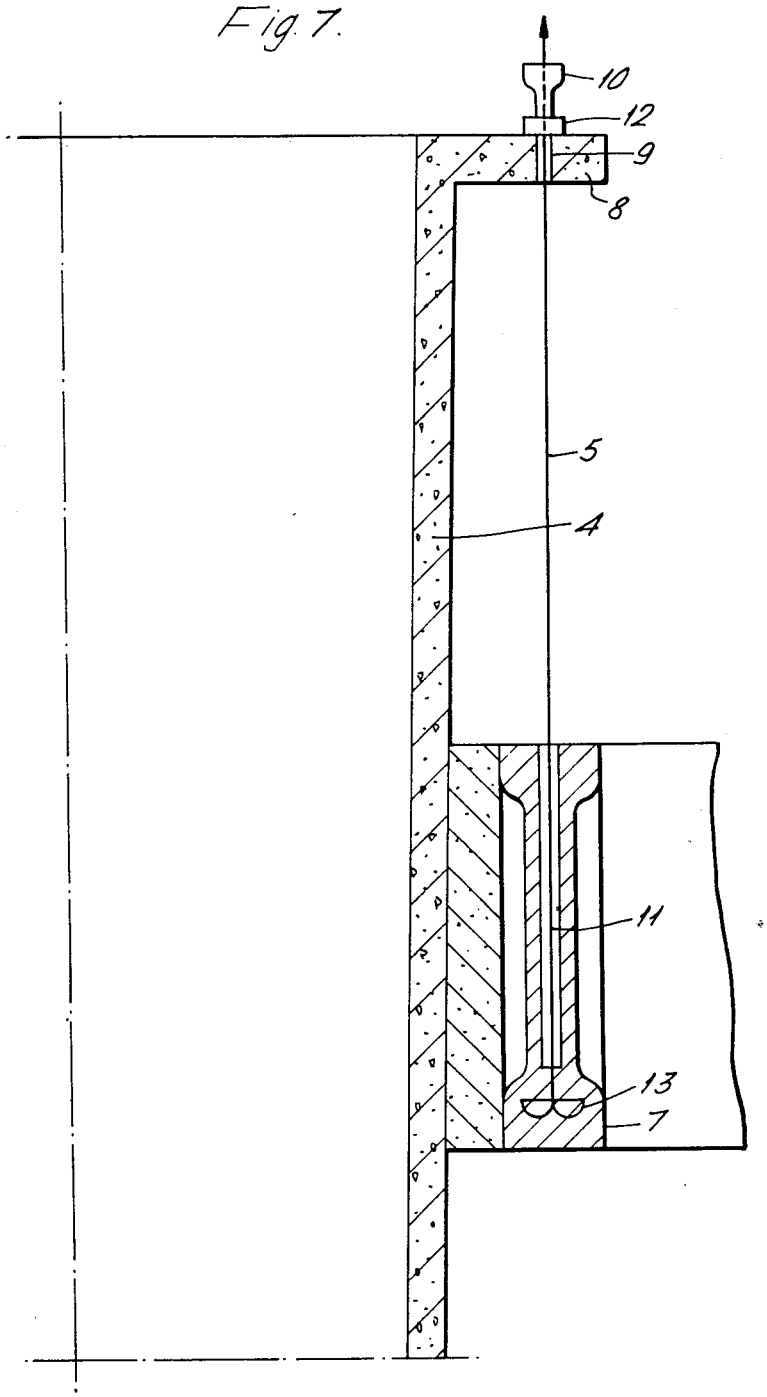
FIG. 7 shows the deck in more detail when in position during lifting operations.
Figure 8:
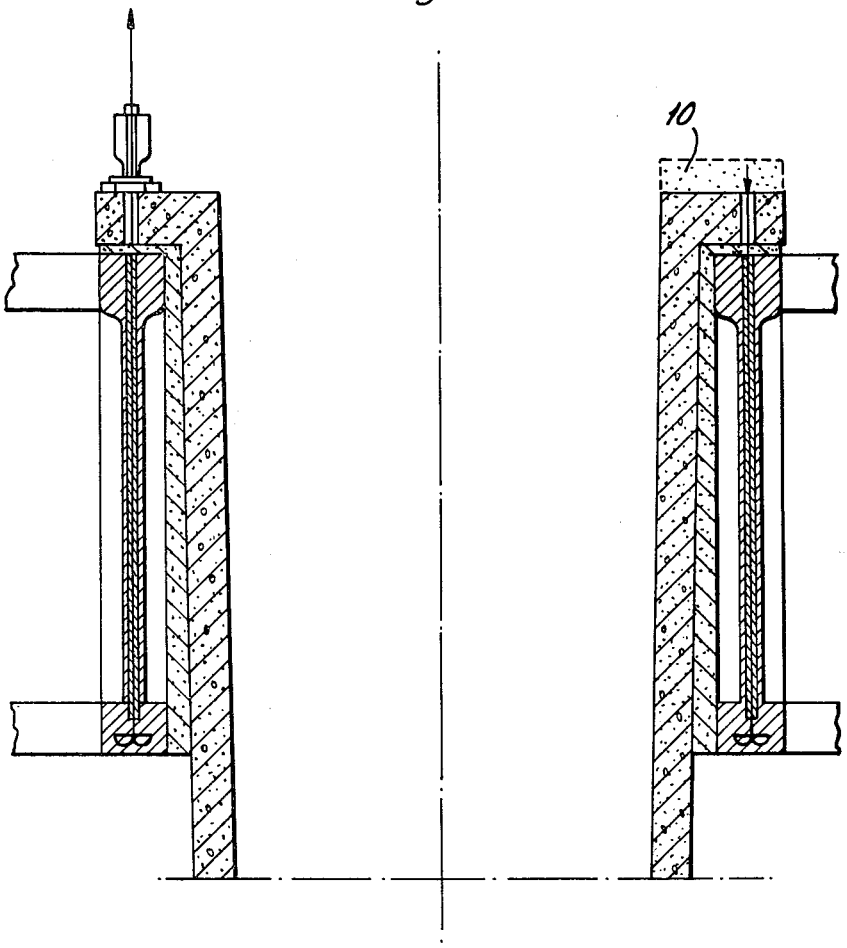
FIG. 8 shows the deck in final position, mounted and injected.

FIG. 7 shows a more detailed vertical section through the tower 4 and the surrounding sections of the deck girders 7, in a transit position during lifting operations. FIG. 8 shows the deck in a mounted position in its final position on top of the tower.

Figure 9:
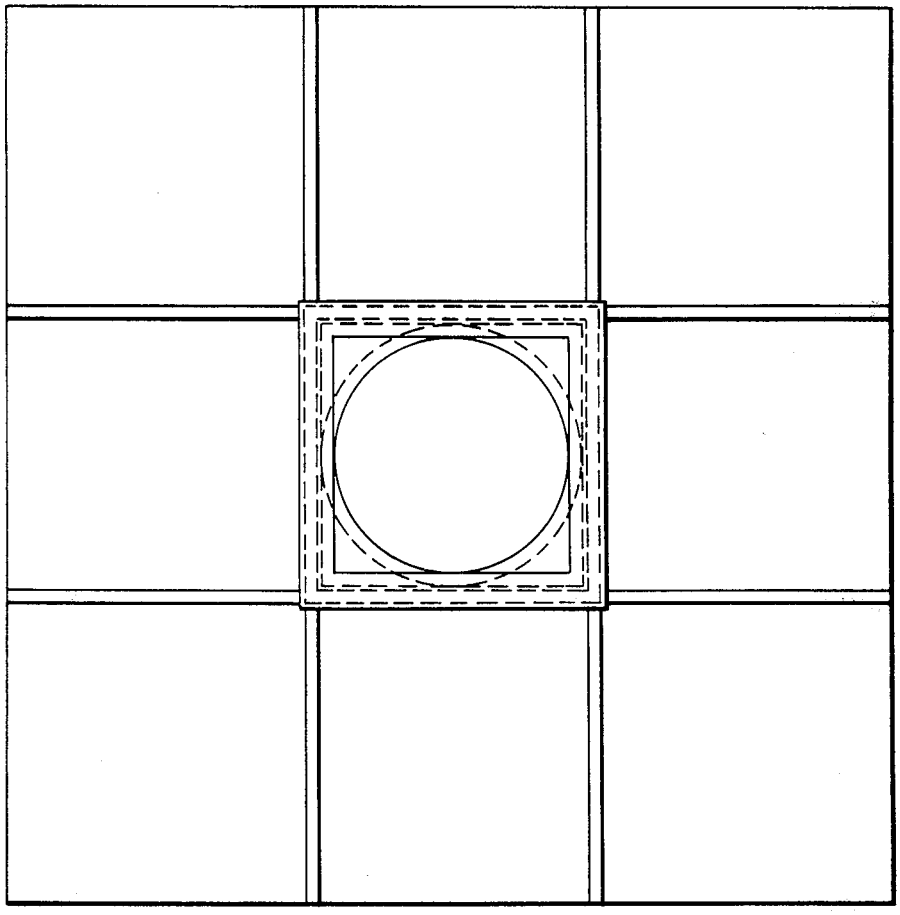
FIG. 9 shows a horizontal section of the tower and girders.

Referring to FIG. 7, girders 7 are in this case formed by I-beams. The tower 4 is equipped with a horizontal collar 8 at its upper end, preferably extending along the entire phriphery of the tower 4. The collar may be rectangularly shaped as shown in FIG. 9, or a circular shape. According to the present invention, the deck, both during lifting operations and in its final position, is suspended from abovementioned collar 8. The collar is therefore designed with several holes or cavities 8 along its pheriphery, to house the lifting cables 5.

A conventional clamping device 12 and a jack 10 are arranged covering each hole. The lifting cables/rods 5 are at their lower end secured by a passive anchor 13 to the lower part of the girders. The remaining part of the cables located inside the girders, run freely inside vertical holes or steel pipes 11 in the girders, at least during lifting and suspending operations. Each of the lifting cables runs up through aforementioned holes 9 in the collar 8, through the clamping device 12 and connects with the jack 10. Since the lifting-rods/cables 5 extend down into the lower half of the girders, the cables 5 will, after tensioning, form part of the shear reinforcement. Further, a controllable extension when applying the tensioning force is also reached.

Upon termination of the tensioning, the pipes 11 and possibly the space found between the girders 7, the tower 4 and the collar 8 may be injected with grouting as shown in FIG. 8. The girders 7 may also, if required, be fastened to the tower 4 in a horizontal direction. When the tensioning of the cables/rods is completed, the jacks are removed. The clamping anchoring devices 12 are then protected against corrosion by an epoxy coating or concrete layer.

FIG. 9 shows a horizontal view of the deck girders 7 and the tower 4.

During lifting operations the deck/sections 2 is protected against unwanted movements, caused for instance by current, waves or unwanted, sudden loads. Separate tension rods/cables with locking bolts not shown may be utilized as safety measures. These are anchored to the supporting structure by means of a retaining plate arranged on both the lower and upper flange with locking bolts or tension bolts, respectively. The abovementioned safety rods are arranged freely in suitable holes/cavities in the girders 7 and extend down towards the supporting structure 6 where they are fastened. Detrimental relative movement is prevented by giving the safety rods/cables the necessary tension by means of the tension bolts with bolt locks and by locking the deck in place with the same.

During that part of the hoisting operations where the deck superstructure still is subjected by buoyancy and wave action, the tension in the safety rods is successively released by releasing the bolt locks on the upper side of the deck superstructure and while the bolt locks on the lower side is correspondingly tightened.

When the deck superstructure has reached a height where said detrimental relative movement does not occur, the safety rods with locking means are removed.

According to the present invention, a rigid and monolithic joint between the deck superstructure and the supporting structure is achieved. By choosing the level of prestressing from a criterion that tensile forces are to be avoided in the joint between the deck superstructure and the supporting structure, a structure which is resistant to cyclic loads (fatigue) is achieved.

In the claims the phrase "at least a section of the superstructure" is intended to cover a part or the whole of the superstructure, the term "column" also includes "tower", the term "cable" includes "rod" and the term "aperture" includes bolts, holes recesses or pipes.

What we claim is:

1. A method for mounting a deck superstructure, comprising at least one concrete girder, on a supporting structure intended to operate in marine surroundings, the supporting structure comprising at least one column extending above sea level, said method comprising the steps of bringing at least one section of the deck superstructure which includes the at least one concrete girder into position relative to the column; hoisting the at least one section of the deck superstructure up into a final position by means of cables and a jacking system; and tensioning the cables upon arrival of the at least one section of deck superstructure in the final position thereof, the lower end of the cables being permanently anchored to the at least one concrete girder while the upper ends of the cables is connected to hoisting and tensioning means arranged on top of the column; the lower part of the cables being arranged within the at least one concrete girder in such a way that the cables, upon tensioning thereof subsequent to the arrival of the at least one section of the deck superstructure at the final position thereof, form an integral part of the static system of the deck superstructure thereby providing both vertical and shear reinforcement.

2. A method as claimed in claim 1, wherein the lower end of the cables are permanently anchored to the lower half of the at least one concrete girder, the remaining part of the cables which are encased by the girder laying free in vertical apertures in said girder during the hoisting and tensioning operations.

3. A method as claimed in claim 2, wherein said vertical apertures are grouted subsequent to tensioning of the cables.

4. A method as claimed in claim 1, wherein the deck superstructure rests with at least part of the weight thereof on the supporting structure prior to hoisting operations, the weight being thereafter transferred to the jacks and the cables.

* * * * *